United States Patent [19]

Hoppe

[11] 4,433,919

[45] Feb. 28, 1984

[54] DIFFERENTIAL TIME INTERPOLATOR

[75] Inventor: David R. Hoppe, McHenry, Ill.

[73] Assignee: Motorola Inc., Schaumburg, Ill.

[21] Appl. No.: 414,768

[22] Filed: Sep. 7, 1982

[51] Int. Cl.[3] ..... G04F 8/00

[52] U.S. Cl. ..... 368/120; 307/518

[58] Field of Search ..... 368/115–119, 368/120; 235/92 J, 92 JF; 364/569; 343/6, 5 LC, 8; 307/518

[56] References Cited

U.S. PATENT DOCUMENTS

| | | | |
|---|---|---|---|
| 3,675,127 | 7/1972 | McKiernan | 368/119 |
| 3,983,481 | 9/1976 | Nutt et al. | 368/118 |
| 4,097,801 | 6/1978 | Freeman | 368/120 |
| 4,165,459 | 8/1979 | Curtice | 235/92 T |
| 4,234,881 | 11/1980 | Stauers | 343/8 |

*Primary Examiner*—Vit W. Miska

[57] ABSTRACT

A system for measuring the difference in time between two unknown signals utilizing a pair of matched delay lines with taps which are differentially separated in time. Each pair of output taps from the two delay lines is fed to a dc flip flop or other sensor which determines which of the two inputs occurs first in time. When there is a transition in the sequence of input signal timing a ROM determines the particular pair of taps which provided that change in sequence and delivers a series of least significant bits representative thereof.

4 Claims, 2 Drawing Figures

DIFFERENTIAL TIME INTERPOLATOR

FIELD OF THE INVENTION

The circuit of the invention relates to a system for measuring very fine time resolution periods between pulses. It may also be used to measure very small pulse widths.

BACKGROUND OF THE INVENTION

There are a number of applications which require accurate measurement from a start to a stop pulse, such as, for example, a TOA (time of arrival) pulse in a radar system or narrow width pulses. Where extreme accuracy is required for such a measurement, typically a very high speed clock has been used to drive a counter. The accuracy has been limited by the resolution in the counter. The resolution of such a system is limited by clock speed (repetition rate), the upper limit of the counter rate. The resolution accuracy is never better than the period of the clock pulse repetition rate.

SUMMARY OF THE INVENTION

The limited resolution available from prior art digital pulse timing systems is improved by means of the use of a differential delay interpolator in the present invention. The difference in time between two electrical events is determined by sending each of the event signals down a first and second delay line, respectively. The first and second delay lines are tapped at marginally different points in order to generate a differential output signal from corresponding taps. Each pair of taps, one from each delay line, is applied to the two inputs of a dc flip flop which allows a time comparison to be made in each case by serving as a first-come-first served circuit. Where, for example, the output from a tap from a first delay line occurs before the output of the corresponding tap from a second delay line, flip-flop 1 is set to the "zero" state, for example. When the output from the second delay line occurs before a corresponding output from a tap on the first delay line, the flip flop would be set to the "one" state. By looking at the outputs of successive flip flops the point may be sensed where the transition from a "zero" to a "one" occurs indicating a reversal in the time phase between the output taps from the first and second delay line, respectively. Since the differential delay in the two lines is predetermined, the point at which a zero to one transition occurs down the row of flip flops is determinative of the delay between the two input pulses. Since no clock pulse is employed, the system does not depend upon clock timing for its resolution.

The least significant bits (L.S.B.) of the delay between two input pulses may be determined by means of a read-only memory (ROM) connected to the outputs of the series of flip-flop sensors. It will be clearly seen that a particular set of least significant bits may be determined by the position of the transition from a zero to a one in the string of dc flip flops. The accuracy of such a system is limited only by the accuracy of the delay lines.

It is therefore an object of the invention to generate the least significant bit representation of the delay between two time displaced input signals by utilizing differential delay lines feeding a series of time phase sensors.

It is another object of the invention to measure the time difference between two electronic events without the use of a high-speed clock.

It is still another object of the invention to improve the resolution of a pulse timing system by a factor which is a function of the difference in tap delays on two delay lines.

These and other objects of the invention will be better understood upon study of the detailed description of the invention, infra, together with the drawing wherein.

DETAILED DESCRIPTION OF THE INVENTION

The invention comprises an improved circuit for measuring the difference in time between two input events without respect to any system clock signal. The circuit to be described allows measurement of least significant bits which may be utilized to improve the resolution of a conventional start-stop digital lapsed time counter or another such device which might be used for the same purpose. In a conventional counter, the start pulse may be synchronized with a system clock in order to avoid the necessity for measuring fractional clock cycles at start time. However, in that case, the stop pulse may not be so synchronized and there is a resolution error induced unless some method is used to record fractions of the clock cycle at the system stop time. The instant invention provides such a fractional measurement at low cost and low complexity.

Figure 1:
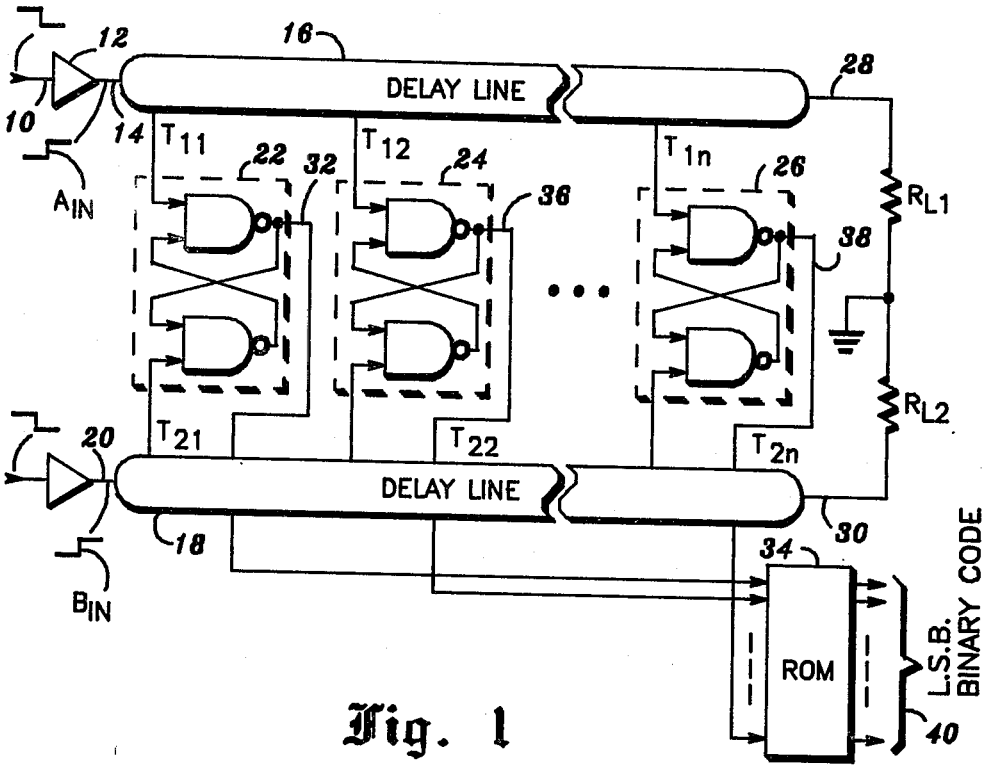
FIG. 1 is a block diagram of a preferred embodiment of the invention.

Referring to FIG. 1, the earlier of two input pulse signal edges is applied at terminal 10. Buffer amplifier 12 inverts the signal at point 14. The positive going signal, $A_{IN}$, at point 14 is introduced to delay line 16. Delay line 16 has tapped outputs at $T_{11}$, $T_{12}$ and through $T_{1N}$. Delay line 18 has taps at $T_{21}$, $T_{22}$ through $T_{2N}$. If delay line 16 is used for the earlier of two event signals, such as $A_{IN}$ as shown at point 14, then the delay between the $A_{IN}$ input at point 14 and the output at $T_{11}$ must be greater than the delay between the input $B_{IN}$ at point 20 and the output of delay line 18 at $T_{21}$. This differential delay will be referred to as $\Delta t$. $\Delta t$ may be chosen to be any suitable value for the use intended. $\Delta t$ may be defined alternatively as the difference in delay between input 14 and output $T_{11}$ of delay line 16 and input at point 20 and the output of delay line 18 at $T_{21}$. It will also be the difference between the delay between $T_{11}$ and $T_{12}$ of delay line 16 and the delay between $T_{21}$ and $T_{22}$ of delay line 18. The relationship will hold between any adjacent corresponding pairs of outputs $T_{1i}-T_{1(i-1)}$ and $T_{2i}-T_{2(i-1)}$ from the two delay lines:

$$\Delta t=[T_{1i}-T_{1(i-1)}]-[T_{2i}-T_{2(i-1)}]$$

$T_{11}$ and $T_{21}$ are fed, respectively, to the inputs of flip-flop 22, a dc flip-flop with a set, reset and an output terminal. Similarly taps $T_{12}$ and $T_{22}$ are fed to the inputs of flip-flop 24 and $T_{1n}$ and $T_{2n}$ are fed respectively to the inputs of flip-flop 26. Output 28 of delay line 16 and output 30 of delay line 18 are terminated by resistors $R_{L1}$ and $R_{L2}$, respectively, each of them being tied to ground. The purpose of these resistors is to properly terminate delay lines 16 and 18 to prevent reflections. Output 32 of flip-flop 22 is connected to an input of ROM 34. Output 36 of flip-flop 24 is tied to another input of ROM 34 and likewise output 38 of flip-flop 26 is tied to another input of ROM 34. ROM 34 is arranged as a look-up table which senses a transition in two adjacent flip-flops, such as 22 and 24, at their respective outputs 32 and 36. The particular flip-flop in the series of N flip-flops which first demonstrates a change in state is determinative of output 40 of ROM 34. The look-up table in ROM 34 is arranged to provide a digital output representative of at least the least significant bit of the time difference between the two input signals. Depending on the value of $\Delta t$ and the length and number of taps on delay lines 16 and 18, any number of least significant bits may be accomplished in this manner.

Figure 2:
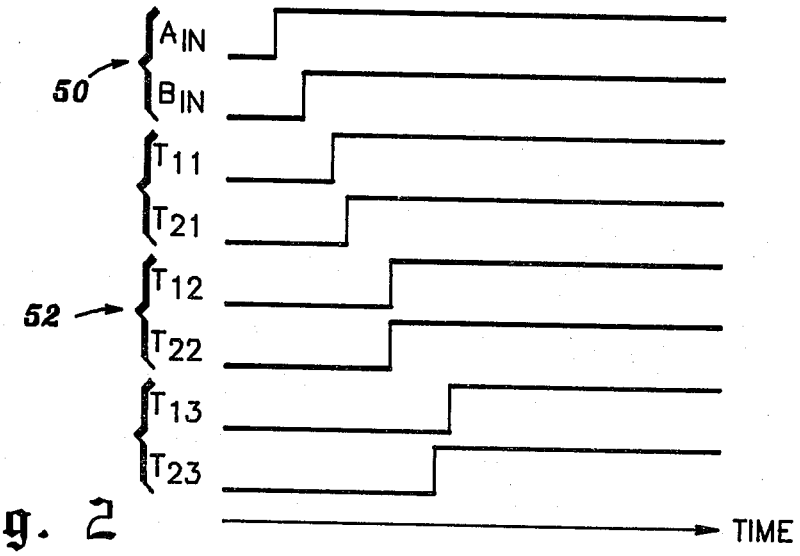
FIG. 2 is a timing diagram for one embodiment of the circuit of FIG. 1.

FIG. 2 is illustrative of a simple example of the operation of the circuit of FIG. 1. The pair of signals 50 comprising $A_{IN}$ and $B_{IN}$ are shown displaced in time by $2\Delta t$. This displacement has been chosen in order to make the example a simple one. By the time the signals have propagated to outputs $T_{11}$ and $T_{21}$, of delay lines 16 and 18, respectively, their time difference has been reduced to $\Delta t$. This is because there is a $\Delta t$ difference in the delay between point 14 and $T_{11}$ of delay line 16 and point 20 and $T_{21}$ of delay line 18. By the time the respective signals reach taps $T_{12}$ and $T_{22}$ they are in coincidence 52. This is because an additional $\Delta t$ differential has been generated between taps $T_{11}$ and $T_{12}$ on the one hand and $T_{21}$ and $T_{22}$ on the other. By the time the signals have reached taps $T_{13}$ and $T_{23}$ (not shown in FIG. 1) the signal $B_{IN}$ has been delivered from delay line 18 prior to the time when signal $A_{IN}$ has been delivered from delay line 16.

Flip-flop 22 sees the signal on $T_{11}$ before it sees the signal on $T_{21}$. It therefore outputs a low level at output 32 which represents a "zero" output. Flip-flop 24 is presented with simultaneous signals from $T_{12}$ and $T_{22}$ therefore the output at point 36 is indeterminant but settles in one of two states. A third flip-flop (not shown) is presented with the signals from $T_{13}$ and $T_{23}$ and since the signal on $T_{23}$ precedes the signal on $T_{13}$ the output of this flip flop will be a "one". It may be seen then that the transition occurs either on flip-flop 24 or the succeeding flip-flop. This demonstrates that the resolution of the system provides an accuracy within one tap position on the delay line. ROM 34 senses the transition between any two adjacent input lines, such as 32, 36, and provides an output on lines 40 which is digitally representative of a number of least significant bits (L.S.B.) as chosen by design.

It will be understood by those skilled in the art that various other modifications and changes may be made to the present invention utilizing the principles of the invention described above without departing from the spirit and scope thereof as encompassed in the accompanying claims. Therefore it is intended in the appended claims to cover all such equivalent variations as come within the scope of the invention as described.

What is claimed is:

1. A circuit for accurately determining a time between a first occurring and a second occurring signal event comprising:

first means for delaying the first occurring signal event, said first means having an input tap adapted for receiving the first occurring event signal, said first means having a successive series of n output taps, each of said first means of n output taps having a predetermined first time delay with respect to each preceding tap of said first means;

second means for delaying the second occurring signal event, said second means having an input tap adapted for receiving the second occurring event signal, said second means having a successive series of n output taps corresponding to said series of n output taps of said first means, each of said second means series of n output taps having a predetermined second time delay with respect to each preceding tap of said second means, said second predetermined time delay being shorter than said first predetermined time delay;

n means for sensing, each of said n means for sensing having a set, a reset and an output terminal, said set and reset terminals of each of said n sensing means being connected to said corresponding output taps of different ones of said series of n output taps of said first means and said second means, respectively; and means for converting a one and a zero set in any specific pair of adjacent ones of said n means for sensing to a unique output signal responsive to said specific pair.

2. A method for accurately measuring a time between first and second occurring signal events comprising the steps of:

delaying the first occurring signal event in a first delay device for producing n first time spaced delay signals, each of said delay signals appearing on one of n output terminals of said first delay device;

delaying the second occurring signal event in a second delay device for producing n second time spaced delay signals appearing on one of n corresponding output terminals of said second delay device;

sensing a relative time of arrival of said signals on successive ones of said corresponding output terminals of said first and second delay devices; and determining at which successive pair of said corresponding output terminals on said first and second delay devices said second delayed signal first occurs prior to said first delayed signal.

3. The method according to claim 2 further comprising the step of:

converting results of said determining step to a digital form in a table-look-up device.

4. The method according to claim 3 wherein said table-look-up device is a read only memory.

* * * * *